US008066016B2

(12) United States Patent
Henninger et al.

(10) Patent No.: US 8,066,016 B2
(45) Date of Patent: Nov. 29, 2011

(54) HAIR STYLING DEVICE

(75) Inventors: Friedrich Henninger, Kelkheim (DE); Jürgen Seng, Kelkheim (DE); Dieter Liebenthal, Maintal (DE)

(73) Assignee: Braun GmbH, Kronberg (DE)

( * ) Notice: Subject to any disclaimer, the term of this patent is extended or adjusted under 35 U.S.C. 154(b) by 705 days.

(21) Appl. No.: 11/817,708

(22) PCT Filed: Mar. 1, 2006

(86) PCT No.: PCT/EP2006/001858

§ 371 (c)(1),
(2), (4) Date: Oct. 29, 2007

(87) PCT Pub. No.: WO2006/092282

PCT Pub. Date: Sep. 8, 2006

(65) Prior Publication Data

US 2008/0196739 A1 Aug. 21, 2008

(30) Foreign Application Priority Data

Mar. 4, 2005 (DE) ..... 10 2005 010 568

(51) Int. Cl.
*A45D 2/40* (2006.01)
*A45D 1/04* (2006.01)

(52) U.S. Cl. ..... 132/224; 132/225; 219/225

(58) Field of Classification Search ..... 132/224–226, 132/245, 263, 229, 230, 231, 232; 219/225
See application file for complete search history.

(56) References Cited

U.S. PATENT DOCUMENTS

| | | | | |
|---|---|---|---|---|
| 2,152,359 | A * | 3/1939 | Pontiatiff | 132/211 |
| 4,841,127 | A * | 6/1989 | Prager et al. | 219/225 |
| 5,125,989 | A * | 6/1992 | Hallman | 148/247 |
| 6,070,596 | A | 6/2000 | Altamore | |
| 6,325,072 | B1 | 12/2001 | Smetana | |
| 6,615,847 | B1 * | 9/2003 | Hagelstam | 132/225 |
| 6,945,255 | B2 * | 9/2005 | Kampel et al. | 132/226 |
| 2004/0163662 | A1 * | 8/2004 | Kampel et al. | 132/226 |
| 2005/0016557 | A1 * | 1/2005 | Fasan | 132/132 |
| 2005/0051188 | A1 * | 3/2005 | Leung | 132/224 |
| 2005/0183283 | A1 | 8/2005 | Evanyk et al. | |
| 2006/0150996 | A1 * | 7/2006 | Lun et al. | 132/224 |

FOREIGN PATENT DOCUMENTS

| | | | |
|---|---|---|---|
| CH | 473 225 | | 7/1969 |
| DE | 17 58 620 | | 3/1971 |
| DE | 699 10 057 | | 4/2004 |
| DE | 600 16 390 | | 10/2005 |
| EP | 1 030 571 | | 4/2002 |
| EP | 1 402 798 | | 3/2004 |
| GB | 333107 | | 8/1930 |
| JP | 2000054090 | A * | 2/2000 |
| JP | 2001104036 | A * | 4/2001 |
| JP | 2005-087629 | | 4/2005 |
| WO | WO2004/073446 | | 9/2004 |

* cited by examiner

*Primary Examiner* — Robyn Doan
(74) *Attorney, Agent, or Firm* — Jeffrey V Bamber; Jerry J Yetter

(57) ABSTRACT

A hair styling device with a handle part, at least one heater part and two metallic molded parts that are preferably made of aluminum or an aluminum alloy and serve, in particular, for straightening, curling or waving hair. Hairs can be inserted between facing contact surfaces of the molded parts and the molded parts can be changed from an open state into a closed state. In order to ensure particularly good sliding properties for the hair, the invention proposes that the contact surfaces are at least regionally provided with an enamel coating.

18 Claims, 2 Drawing Sheets

HAIR STYLING DEVICE

TECHNICAL FIELD

The invention pertains generally to heated hair styling devices. More particularly, the invention pertains to hair styling devices with a handle, a heater and molded clamping implements for straightening, curling or waving hair.

BACKGROUND

A hair styling device of this type is discussed, for example, in EP 1 030 571 B1. The metallic molded parts of this hair styling device are covered with a thin layer of lacquer or anodized, if the molded parts are made of aluminum or an aluminum alloy, treated by means of an anodizing method (in order to produce an oxide layer). These lacquer layers or oxide layers are respectively applied onto the molded parts in order to realize a smoother surface than that of non-treated metallic molded parts such that the hairs to be styled are subjected to the least mechanical stress possible when the hair styling device is used. The hairs are subjected to this stress due to the fact that the hair strands to be styled are clamped between the molded parts during the styling process and a clamping force acts upon these hair strands. The hair styling device is moved along the hair strands with a tensile force while the hairs are heated by the heating part. The effectiveness of the hair styling process increases proportionally with the intensity of the tensile force exerted upon the hairs. However, the intensity of the tensile force has an upper limit. This limit is defined by damage to the hairs that is caused by the mechanical stress resulting from the tensile force and the simultaneous thermal stress. If the tensile force is excessive, the user also experiences unpleasant tension at the hair line that is caused by the movement of the hair styling device relative to the hair.

In known hair styling devices in which the molded parts of aluminum or an aluminum alloy are provided with anodized contact surfaces, the average surface roughness amounts to approximately 4 μm. However, this surface roughness does not rule out damage to the hairs and unpleasant tension at the hair line because the hair surface itself has a structure between 3 μm in 7.5 μm and the hairs therefore have inferior sliding properties between the contact surfaces of the molded parts. The unpleasant tension at the hair line also makes the hairs more susceptible to damage because the potential dwell time of the hairs between the contact surfaces is longer in this case. It has been determined that galvanized contact surfaces typically result in the hairs sliding excessively fast between the contact surfaces such that no satisfactory styling of the hairs can be achieved.

What is needed, therefore, is a hair styling device that avoids unacceptably high damage to the hairs and stress on the hairs, as well as unpleasant tension at the hair line of the user. The heating of the hairs for the styling process should also be optimized.

SUMMARY

A hair styling device according to the invention, includes contact surfaces that are at least regionally provided with an enamel layer. The enamel creates a very gentle contact surface for the hairs. Excessive damage to the hairs to be styled due to mechanical stress, as well as excessive tension at the hair line of the user, are prevented. The hairs neither slide excessively fast nor excessively slow between the contact surfaces.

In contrast to conventional surface coatings, the enamel is also extremely resistant to scratching, abrasion and wear, such that the contact surfaces also have good service value.

The enamel layer has a sufficiently smooth surface that, however, is not excessively smooth for this application, such that the contact surfaces provided with this enamel layer can be cleaned particularly well and also have superior sliding properties with respect to the hairs at high temperatures.

In comparison with known surface coatings of hair styling devices, such enamel layers are also non-fading and non-discoloring, as well as particularly corrosion-resistant due to the high resistance to scratching, abrasion and wear. In comparison with lacquered or anodized surfaces, the enameled surface practically does not change over time, such that an appealing optical appearance and high service value are preserved over the entire service life of the device.

It was determined that it is particularly advantageous to manufacture the metallic molded parts of a wrought aluminum alloy that contains magnesium and/or silicone with a Mg content between 0-1.5%, preferably between 0.3-0.9%, and, if applicable, Si as a second alloying component. One such alloy, e.g., is $AlMgSi_{0.5}$.

It is particularly advantageous to enamel the entire facing contact surfaces of the molded parts. This measure ensures uniform heat transfer from the contact surfaces to the hairs to be styled, as well as a particularly gentle and stress-free treatment of the hairs due to the homogenous and smooth surface of the contact surfaces.

In order to prevent tensions in the molded parts provided with the enamel layer during the enameling and the ensuing cooling process in instances in which only the contact surface is enameled, it is practical to enamel the entire surface of the molded parts. If the molded parts are formed as hollow extruded profiles, it suffices to enamel only the outwardly directed surfaces of the molded parts because tensions that could lead to damage to the enamel due to its brittleness primarily occur on the outwardly directed surfaces in hollow bodies.

According to some embodiments of the invention, the thickness of the enamel layer lies between 10 μm and 140 μm, preferably between 40 μm and 120 μm. However, the enamel layer advantageously has a thickness of at least 40 μm.

According to some embodiments of the invention, the metallic molded parts feature a base layer in the form of a chromate coating or phosphate coating, onto which the enamel layer is applied. Pretreatments of this type, particularly with $Cr^3$ complexes or $PO_4^2$ complexes, serve as an adhesion promoter between the metallic surface of the molded parts and the enamel layer. This ensures a particularly stable connection or adhesion between the metallic molded parts and the enamel layer.

This effect can also be achieved by roughening the metallic surface of the molded parts before the enamel is applied. It would be conceivable to blast the molded parts with fine corundum particles for this purpose. This blasting could naturally also be carried out in addition and prior to a chromate coating or phosphate coating of the surfaces.

According to an independent aspect of the invention, at least one of the molded parts of a hair styling device features a rounded inlet edge and/or outlet edge that extends along the longitudinally extending boundary of the molded part. This ensures that the hairs are always gently styled when the hair strands move into and out of the device, avoiding excessively sharp inlet and outlet edges that could otherwise damage individual hairs or exert unpleasant tension on the hair line of the user.

In this context, it is particularly advantageous that the inlet edge and/or outlet edge has a radius of 0.5 mm to 5 mm, preferably 1 mm. This ensures that the hairs are styled in a particularly gentle fashion because there are no excessively sharp edges of the molded parts to act upon the hairs when they move into and out of the device.

According to another independent aspect of the invention, at least one of the molded parts of a hair styling appliance is provided with at least two spacers on its contact surface that faces the other molded part, such that a gap is formed between the contact surfaces. This ensures that all hair strands, can easily slide through the hair styling device and are not pulled out or subjected to undesirably high tensile forces as fewer and fewer hairs are situated between the two molded parts.

This feature is particularly effective if the spacers are spherical dome segments that have a radius of 1 to 8 mm, such as a radius of 6 mm, and protrude from the contact surface by 0.1 to 1 mm, preferably by 0.15 mm to 0.25 mm. Due to this measure, the intermediate space between the closed contact surfaces is approximately adapted to the hair diameter and the surface structure of the hairs, such that individual hairs on the ends of the strands are not pulled out or undesirably high tensile forces applied to individual hairs. If thinner flat or planar molded parts are used for this purpose and an enamel layer is additionally applied, the entire surface of the molded parts should be enameled such that any compressive stresses are symmetrically distributed. This prevents distortions of such thin molded parts that could occur with a one-sided enameling, due to high compressive stress.

It is advantageous to arrange these projections on opposite ends of a molded part such that the two molded parts can be placed against one another in the most stable fashion possible. Consequently, the clamping force has about the same intensity over the entire contact surfaces.

In some embodiments, at least one of the molded parts is detachably held on the handle part. This makes it possible to remove the at least one molded part, for example, for cleaning purposes or to completely exchange this molded part. This furthermore makes it possible to utilize different version of the molded part, such as different geometries, for example, for straightening or waving or curling the hairs. This feature is also particularly advantageous with respect to the manufacturing technology.

Other objectives, advantages, characteristics and possible applications of the present invention are described below with reference to the figures. In this respect, all described and/or illustrated characteristics form aspects of the present invention individually or in any combination.

DESCRIPTION OF DRAWINGS

Like reference symbols in the various drawings indicate like elements.

DETAILED DESCRIPTION

Figure 1:
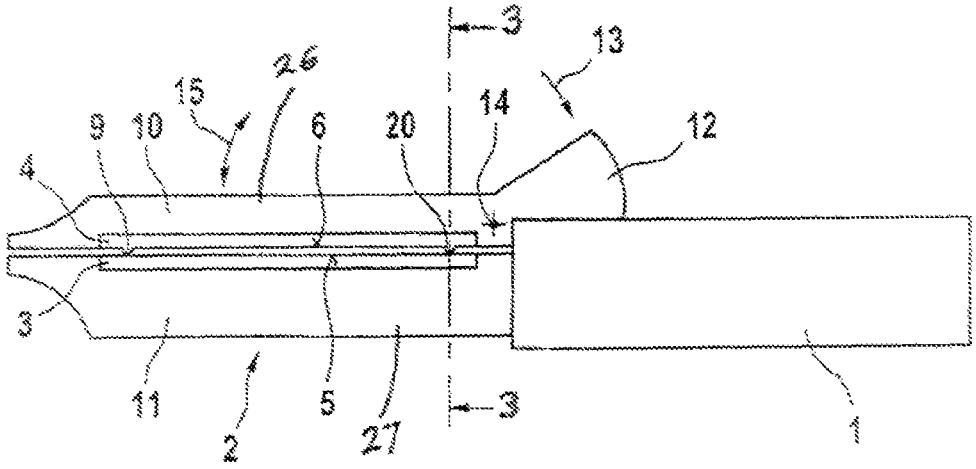
FIG. 1 is a schematic side view of a first gas operated hair styling device with a rigid and a movable arm.
Figure 2:
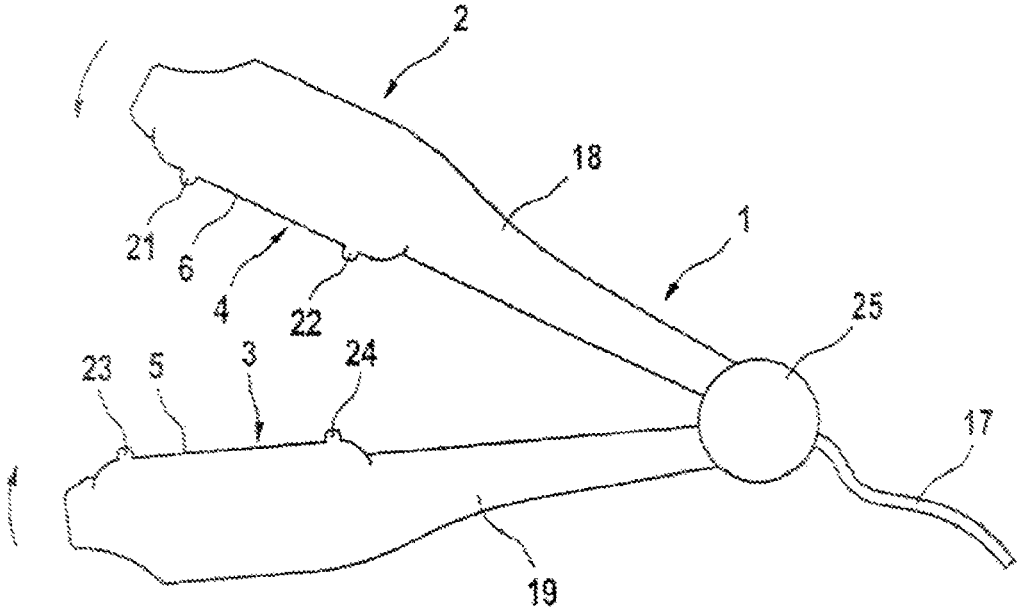
FIG. 2 is a schematic side view of a first electrically operated hair styling device with two tong-like movable arms.

The hair styling device according to FIGS. 1 and 2 features a handle part 1 and a heater part 2. The heater part 2 is arranged on and forms an extension of the handle part 1 and may be electrically operated (see FIG. 2) or gas-operated (see FIGS. 1 and 3). The hair styling device according to FIG. 1 features an energy source in the form of an (not-shown) exchangeable gas cartridge that is arranged in the handle 1 and supplies a catalyst 16 (see FIG. 3) in the heating part 2 with energy in order to realize flameless combustion. The hair styling device according to FIG. 2 is connected to the power supply by means of a cable 17 in order to supply an (not-shown) electric heating device in the heater part 2 with energy.

In the hair styling device according to FIG. 1, the heater part 2 includes long-like arms 10, 11 that are pressed against one another by means of a spring force. In this case, one of the arms 11 is stationarily connected to the handle 1. The second arm 10 can be pivoted away from the first arm 11 about the pivoting point 14 by pressing the actuating lever 12 in the direction indicated by the arrow 13. This makes it possible to move the second arm 10 relative to the first arm 11 in the direction indicated by the arrow 15, namely into an open position and a closed position. In the normal position of this hair styling device in which no lever is actuated, the two arms adjoin one another in the closed position.

In the hair styling device according to FIG. 2, the heater part 2 as well as the handle part 1 are divided into two tong-like arms 18, 19 that are pressed against one another by means of a spring force. The arms are connected to one another by means of a rotary joint with spring prestress 25. In this case, the normal position in which no force is exerted upon the arms 18, 19 is the open position, in which the two arms 18, 19 are spaced apart from one another at an acute angle.

It goes without saying that other examples may combine the features of the two examples of FIGS. 1 and 2, to produce other hair styling devices. The hair styling devices according to FIGS. 1 and 2 are hair straighteners, i.e., the hairs to be straightened are placed between the arms 10, 11, 18, 19 and then pulled through the device under the influence of heat and a certain pressing force exerted upon the arms such that the hairs are straightened. Alternatively, it would also be conceivable, for example, that hot steam be additionally provided to act upon the hairs between the arms.

Figure 3:
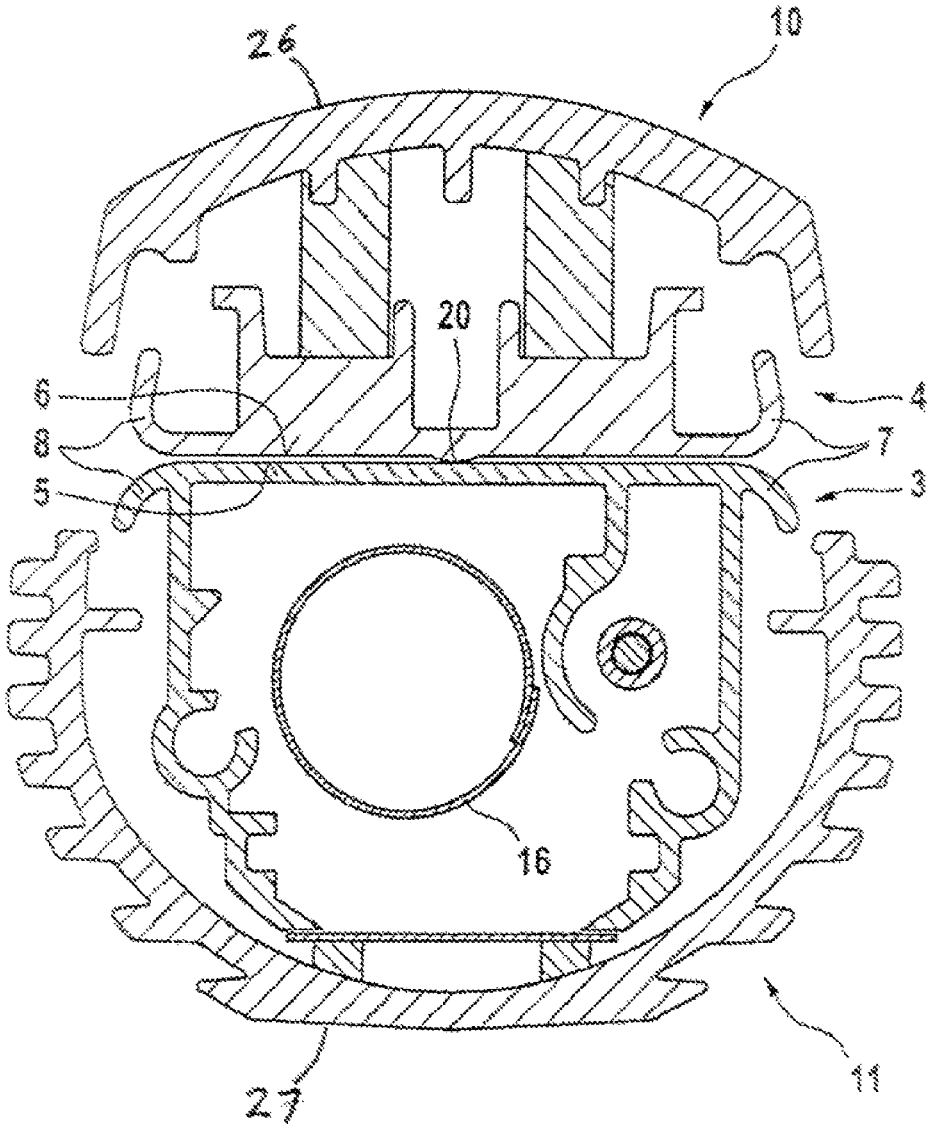
FIG. 3 is a sectional view along the line 3-3 in FIG. 1.

The hair styling device according to FIGS. 1 to 3 features two metallic molded parts 3, 4 that consist of aluminum in this case, with the heater part 2 in the form of the molded part 3. It would also be possible to provide these two parts separately. It would furthermore be possible to assign another separate heater to the molded part 4, such that both facing molded parts are heated. It would also be conceivable to only heat the other molded part 4 that, according to FIG. 1, is not arranged on the handle part. Arms 10 and 11 include housing shells 26, 27 connected to the molded parts 3, 4 opposite the contact surfaces 5, 6 of the extruded aluminum profiles.

The heater part 2 is an elongated heating rod with essentially circular cross section. The molded parts 3, 4 feature a planar contact surface on which the hairs are styled. However, it would also be conceivable to provide the contact surfaces with different cross sections, e.g., circular cross sections or cross sections that are curved with a certain radius. The heater part 2 defines a longitudinal axis of the hair styling device.

Hair styling devices of the present type may be provided with two molded parts that feature essentially planar surfaces, between which the hairs can be inserted. Hair styling devices of this type serve, for example, for straightening the hairs.

The molded parts 3, 4 are provided with an enamel coating on their contact surfaces 5, 6 in order to achieve optimal smoothness or roughness of the contact surfaces 5, 6. Measured over a reference length of 1.25 mm, the roughness value Rz is approximately 0.1-1 μm, and preferably 0.1 to 0.3 μm. The enamel coating contains glass bodies that are melted on the aluminum alloy containing magnesium and, if applicable, silicone at approximately 500° C. to 570° C. This temperature is much lower than that used for comparable steel enameling and therefore is also gentler because no high thermal stresses occur in the aluminum alloy. The enamel coating ensures the required balance between the pressing force and the optimal sliding of the hairs through the device.

In addition, projections of spacers 9, 20 (FIG. 1) are arranged on the molded part 4 in the example shown, in which these projections or spacers prevent the contact surfaces 5, 6 of the molded parts 3, 4 from directly contacting one another. These projections preferably have a radius of approximately 6 mm and protrude from the planar contact surface by approximately 0.2 mm. This means that a gap is formed between the contact surfaces, the gap having a width that corresponds to the height of the projections, namely 0.2 mm in this case. Two projections are preferably arranged in the end regions of the contact surfaces, such that they lie centrally on the longitudinal axis. However, other arrangements are also possible, e.g., one with 4 projections that do not come in contact with one another; see FIG. 2. When straightening hairs without such projections, one may encounter the problem that the force exerted upon the hairs by the contact surfaces of the molded parts 3, 4 being pressed against one another results in such a high tension that individual hairs situated between the contact surfaces are pulled out. The highest tension occurs, in particular, shortly before the hairs are pulled out of the intermediate space between the contact surfaces because only a few hairs are present at that time. If the pressing force is too low, however, the hairs are styled in an inferior fashion. Due to the projections, the hair strands inserted between the arms are subjected to a lower pressing force shortly before they slide out of the molded parts because the projections form a gap between the molded parts. The projections are suitably sized such that when only a small number of residual hairs are situated between the molded parts the hairs can be styled with the required pressing force, but otherwise remain unaffected by the gap formed by the projection.

In order to prevent damage and excessively high stress on the hairs to be styled while the strands of hair are moved into and out of the hair styling device, the molded part 4 is provided with a rounded inlet edge 7 as well as a rounded outlet edge 8 (see FIG. 3).

The molded parts 3, 4 are extruded aluminum profiles. These profile materials result in optimal planar contact surfaces and simultaneously provide the best thermal stability, namely also in the heat-up phase with a temperature gradient in the molded part.

If the hair styling device is closed without any hairs being inserted therein, the molded part 4 contacts the molded part 3 or the heater part 2, respectively, with its projections 9, 10. This state is maintained due to the spring acting upon the actuating lever 15. This is the state in which the hair styling device is usually stored or transported (normal state of the hair styling device according to FIG. 1).

When in use, the hair styling device is opened and the user places the hairs to be styled between the molded parts 3 and 4. The hair styling device is then closed and, as described above, pressed against a limit stop or spacer with the force of the spring assigned to the actuating lever 12. This causes the hairs to be heated by the heater part 2 and to be compressed between the molded parts 3 and 4. Thus, a pressing force acts upon the hairs.

The user can then style the inserted hairs with the hair styling device. The hairs are only subjected to slight stress when they are pulled through the hair styling device because the enamel of the contact surfaces 5, 6 minimizes the friction between the contact surfaces 5, 6 and the hairs. This means that the hairs are only subjected to very light stress and no unpleasant tension is created at the hair line of the user. This effect is additionally improved with the rounded inlet and outlet edges 7, 8. Due to the low friction, the hairs slide very easily between the contact surfaces 5, 6 of the molded parts 3, 4.

The dome-shaped projections 9, 10 also contribute to preventing stresses on the hairs to be styled and unpleasant tensile stresses for the user at the hair line while the hair styling device is used. Due to the projections 9, 20, 21, 22, 23, 24, the contact surfaces 5, 6 do not lie directly on top of one another in their entirety.

A number of embodiments of the invention have been described. Nevertheless, it will be understood that various modifications may be made without departing from the spirit and scope of the invention. Accordingly, other embodiments are within the scope of the following claims.

The invention claimed is:

1. A hair styling device comprising:

a handle, at least one heating element; and two metallic molded parts connected to the handle, at least one of the molded parts being heated by the heating element, the molded parts being selectively configurable in both open and closed states and having respective facing contact surfaces that are configured for styling hair inserted between the facing contact surfaces, wherein the contact surfaces comprise enamel-coated surfaces of aluminum extrusions; wherein the contact surfaces have roughness of approximately 0.1-1 μm; and wherein at least one of the molded parts is provided with at least two protruding spacers facing the other molded part, wherein said spacers maintain a gap from about 0.005 mm to 0.5 mm between the contact surfaces.

2. The hair styling device according to claim 1, wherein the metallic molded parts are made of an aluminum alloy comprising at least one of magnesium and silicone.

3. The hair styling device according to claim 1 wherein the aluminum alloy of the molded parts contains alloying components of 0.1-1.5% Mg.

4. The hair styling device according to claim 3 wherein the aluminum of the molded parts contains alloying components of 0.3-0.9% Mg.

5. The hair styling device according to claim 1 wherein the contact surfaces have a roughness between 0.1 and 0.3 μm.

6. The hair styling device according to claim 1, wherein the contact surfaces are configured for at least one of straightening, curling and waving hair.

7. The hair styling device according to claim 1, further comprising housing shells connected to the molded parts opposite the contact surfaces of the extruded aluminum profiles.

8. The hair styling device according to claim 1, wherein the enamel layer has a thickness of about 10 μm to 140 μm.

9. The hair styling device according to claim 8, wherein the enamel layer has a thickness of about 40 μm to 120 μm.

10. The hair styling device according to claim 1, wherein the molded parts include at least one of a chromate coating and a phosphate coating.

11. The hair styling device according to claim 1, wherein at least one of the molded parts features at least one of a rounded inlet edge and a rounded outlet edge that extends along a longitudinally extending boundary of the at least one molded part.

12. The hair styling device according to claim 11, wherein the at least one of the inlet edge and outlet edge has a radius of about 0.5 mm to 5 mm.

13. The hair styling device according to claim 11, wherein the at least one of the inlet edge and outlet edge has a radius of about 1 mm.

14. The hair styling device according to claim 1, wherein the spacers are provided on the contact surface of the respective molded part.

15. The hair styling device according to claim 1, wherein the spacers are provided on a surface adjacent the contact surface.

16. The hair styling device according to claim 1, wherein the spacers are in the form of spherical dome segments.

17. The hair styling device according to claim 16, wherein the spherical dome segments have a radius of about 1 to 7 mm.

18. The hair styling device according to claim 1, wherein the spacers protrude by about 0.1 mm to 0.25 mm, and wherein a corresponding gap is formed between the contact surfaces adjacent the spacers.

* * * * *